US009040902B2

(12) United States Patent
Ueda et al.

(10) Patent No.: US 9,040,902 B2
(45) Date of Patent: May 26, 2015

(54) ATMOSPHERIC PRESSURE IONIZATION MASS SPECTROMETER

(75) Inventors: Manabu Ueda, Kyoto (JP); Daisuke Okumura, Osaka (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/352,191

(22) PCT Filed: Oct. 17, 2011

(86) PCT No.: PCT/JP2011/073821
§ 371 (c)(1),
(2), (4) Date: Apr. 25, 2014

(87) PCT Pub. No.: WO2013/057777
PCT Pub. Date: Apr. 25, 2013

(65) Prior Publication Data
US 2014/0284473 A1 Sep. 25, 2014

(51) Int. Cl.
*H01J 49/04* (2006.01)

(52) U.S. Cl.
CPC ..... *H01J 49/04* (2013.01); *H01J 49/0445* (2013.01)

(58) Field of Classification Search
CPC ..... H01J 49/04
USPC ..... 250/281, 282, 423 R, 287, 288
See application file for complete search history.

(56) References Cited

U.S. PATENT DOCUMENTS

| | | | | |
|---|---|---|---|---|
| 6,177,669 | B1 * | 1/2001 | Wells et al. | 250/288 |
| 6,207,955 | B1 | 3/2001 | Wells et al. | |
| 2003/0160165 | A1 * | 8/2003 | Truche et al. | 250/288 |
| 2006/0255261 | A1 * | 11/2006 | Whitehouse et al. | 250/288 |

FOREIGN PATENT DOCUMENTS

| | | | |
|---|---|---|---|
| DE | 1 117 993 | T1 | 7/2001 |
| DK | 1 118 097 | T1 | 12/2001 |
| EP | 1 118 097 | A | 7/2001 |
| EP | 1 117 993 | A1 | 12/2001 |
| EP | 1 476 892 | | 11/2004 |

(Continued)

OTHER PUBLICATIONS

International Search Report for PCT/JP2011/073821 dated Nov. 29, 2011.

(Continued)

*Primary Examiner* — David Porta
*Assistant Examiner* — Meenakshi Sahu
(74) *Attorney, Agent, or Firm* — Sughrue Mion, PLLC

(57) ABSTRACT

In an atmospheric pressure ionization source using an ESI or the like having a desolvation pipe with one end opening serving as an ion-drawing port, a drying-gas supplying port for supplying a drying gas against the ion-drawing direction is provided below the ion-drawing port, i.e. at a position opposite to the side where a nozzle for spraying a liquid sample into an atmospheric pressure atmosphere is located, as viewed from the ion-drawing port. When the drying gas is supplied from the drying-gas supplying port, the gas pressure becomes higher in a region above the ion-drawing port becomes higher than in a region below the same port and produces a downward air stream. This stream helps ions in the spray flow from the nozzle to easily come close to the ion-drawing port and be efficiently drawn into the desolvation pipe.

5 Claims, 2 Drawing Sheets

(56) References Cited

FOREIGN PATENT DOCUMENTS

| | | | |
|---|---|---|---|
| JP | 2002-526892 | A | 8/2002 |
| JP | 2003-517576 | A | 5/2003 |
| JP | 2003-322639 | A | 11/2003 |
| JP | 2005-071722 | A | 3/2005 |
| JP | 2006-190526 | A | 7/2006 |
| JP | 2006-208379 | A | 8/2006 |
| JP | 2009-133661 | A | 6/2009 |
| WO | 00/19192 | A1 | 4/2000 |
| WO | 00/19484 | A1 | 4/2000 |
| WO | 03/073461 | A1 | 9/2003 |

OTHER PUBLICATIONS

Japanese Office Action issued Jan. 13, 2015 in Japanese Patent Application No. 2013-539426.

* cited by examiner

ATMOSPHERIC PRESSURE IONIZATION MASS SPECTROMETER

CROSS REFERENCE TO RELATED APPLICATIONS

This application is a National Stage of International Application No. PCT/JP2011/073821 filed Oct. 17, 2011, the contents of all of which are incorporated herein by reference in their entirety.

TECHNICAL FIELD

The present invention relates to an atmospheric pressure ionization mass spectrometer having an atmospheric pressure ion source for ionizing a liquid sample in an ambience of approximately atmospheric pressure.

BACKGROUND ART

In a liquid chromatograph mass spectrometer (LC/MS) in which a mass spectrometer (MS) is used as a detector for a liquid chromatograph (LC), an atmospheric pressure ion source is used to ionize components in a liquid sample eluted from a column, using an electrospray ionization (ESI), atmospheric pressure chemical ionization (APCI), atmospheric pressure photoionization (APPI) or similar ionization method.

In the ESI, a high voltage of a few to several kV is previously applied to the tip of a thin nozzle through which a liquid sample is to be introduced. The high voltage creates an electric field, which causes charge separation in the liquid sample. The charge-separated liquid sample is broken into a nebulized form due primarily to attractive or repulsive coulomb forces. The resultant droplets collide with the ambient air, to be divided into finer particles. Concurrently, the solvent or mobile phase in the droplets vaporizes. During this process, the sample components (molecules or atoms of the sample) in the droplets are released from the droplets together with the electric charges and turn into gaseous ions. In the APCI, a needle electrode is placed in front of the tip of a thin nozzle through which a liquid sample is introduced. The sample components released from the droplets of the liquid sample nebulized by the heated nozzle are made to chemically react with carrier-gas ions (buffer ions) generated by corona discharge from the needle electrode, whereby the sample components are ionized. In the APPI, the sample components released from the droplets of the liquid sample nebulized by the heated nozzle are irradiated with light and thereby ionized.

In any of those ionization methods, an ion-drawing port is placed in front of the spray flow (normally, a stream of ions mixed with micro droplets of unvaporized solvent or the like) ejected from the nozzle. The ions drawn into the ion-drawing port pass through a desolvation pipe, to be transported to subsequent stages under vacuum atmosphere (see Non-Patent Literatures 1-3). The desolvation pipe, which is a heated pipe, does not only serve as a passage for transporting the ions but also has the effect of promoting vaporization of the solvent from the droplets and thereby helping the generation of gaseous ions.

To improve the ion generation efficiency in the previously described atmospheric pressure ion sources, it is necessary to quickly vaporize the solvent and mobile phase in the droplets sprayed from the nozzle. For this purpose, conventional atmospheric pressure ionization mass spectrometers have a system for supplying hot drying gas from the circumference of the ion-drawing port so as to make the spray flow come in contact with the drying gas. For example, in an atmospheric pressure ionization mass spectrometer disclosed in Patent Literatures 1 or 2, a drying-gas pipe is provided coaxially with and around the desolvation pipe so as to supply a drying gas in a ring-like shape from the supplying port at the end of the drying-gas pipe in the direction opposite to the ion-drawing direction. In another commonly known system, a plurality of drying-gas supplying ports are provided around the ion-drawing port and the drying gas is supplied from each of the drying-gas supplying ports.

In an atmospheric pressure ionization mass spectrometer described in Patent Literature 3, a drying-gas supplying port is provided in front of the ion-drawing port so that the drying gas can efficiently come in contact with the spray flow from the nozzle. Furthermore, this system disclosed in Patent Literature 3 has a means for regulating the supplying rate of the drying gas so that the flow rate of the drying gas can be regulated to maximize the ion detection efficiency.

CITATION LIST

Patent Literature

Patent Literature 1: JP-A 2005-71722
Patent Literature 2: JP-A 2006-190526
Patent Literature 3: JP-A 2003-322639

SUMMARY OF INVENTION

Technical Problem

The present inventors have experimentally revealed that the previously described configurations of the conventional atmospheric pressure ion sources, or more specifically, the configuration and structure of the drying-gas supply unit used for promoting volatilization of the solvent and mobile phase in the droplets, are not always appropriate for improving the ion detection sensitivity. The present invention has been developed in view of this fact. Its objective is to provide an atmospheric pressure ionization mass spectrometer in which a larger amount of ions are subjected to mass spectrometry and the ion detection sensitivity is thereby improved.

Solution to Problem

The first aspect of the present invention aimed at solving the previously described problem is an atmospheric pressure ionization mass spectrometer having: a spray device for spraying a liquid into an ionization chamber whose inner space is maintained at atmospheric pressure; and an ion-drawing port for drawing ions generated from micro droplets sprayed from the spray device so as to transport the ions to a subsequent stage maintained at a low gas pressure, the central axis of the ion-drawing port being unidentical with the central axis of a spray flow from the spraying device, wherein:

the mass spectrometer includes a drying-gas supplying port located in a region surrounding the ion-drawing port and at least on the side of the central axis of the ion-drawing port opposite to the side where the spray port of the spraying device is located, the drying-gas supplying port being arranged so as to supply a drying gas in a direction opposite to the direction in which ions are drawn through the ion-drawing port; and the drying gas is supplied only from the aforementioned drying-gas supplying port.

The second aspect of the present invention aimed at solving the previously described problem is an atmospheric pressure ionization mass spectrometer having: a spray device for spraying a liquid into an ionization chamber whose inner space is maintained at atmospheric pressure; and an ion-drawing port for drawing ions generated from micro droplets sprayed from the spray device so as to transport the ions to a subsequent stage maintained at a low gas pressure, the central axis of the ion-drawing port being unidentical with the central axis of a spray flow from the spraying device, the mass spectrometer including:

a) a plurality of drying-gas supplying ports provided around the ion-drawing port in such a manner as to surround the ion-drawing port, the drying-gas supplying ports being directed so as to supply a drying gas in a direction opposite to the direction in which ions are drawn through the ion-drawing port; and b) a flow rate regulator for independently regulating the flow rate of the drying gas supplied from each of the drying-gas supplying ports.

In a preferable mode of the atmospheric pressure ionization mass spectrometer according to the second aspect of the present invention, the plurality of drying-gas supplying ports are arranged at regular intervals of angle on a circle concentric with the ion-drawing port.

While the atmospheric pressure ionization mass spectrometer according to the second aspect of the present invention has a plurality of drying-gas supplying ports, the atmospheric pressure ionization mass spectrometer according to the first aspect of the present invention may have a single drying-gas supplying port or a plurality of drying-gas supplying ports one of which is configured as the aforementioned characteristic drying-gas supplying port.

Given the common knowledge in the technical area concerned, it is evident the term "atmospheric pressure" in the atmospheric pressure ionization mass spectrometers according to the first and second aspects of the present invention does not mean the strict atmospheric pressure which depends on the temperature or other conditions, but any pressure which is approximately equal to the atmospheric pressure.

In the atmospheric pressure ionization mass spectrometers according to the first and second aspects of the present invention, the state in which the central axis of the ion-drawing port is unidentical with the central axis of the spray flow from the spraying device specifically includes the following cases: the two axes orthogonally or obliquely intersect with each other; the two axes are parallel to each other and not on the same straight line; and the two axes are not parallel to each other and do not intersect with each other. In any of these cases, of course, the ion-drawing port should be positioned so that the ions generated from the spray flow can be drawn.

In the atmospheric pressure ionization mass spectrometer according to the first aspect of the present invention, when a drying gas is supplied from the drying-gas supplying port, the flow of the drying gas causes the gas pressure around the ion-drawing port to be lower in a region farther from the spray port of the spraying device (a region near the position of the drying-gas supplying port) as viewed from the ion-drawing port than in a region closer to the spray port. This pressure difference produces a stream of air from the latter region toward the former. Being carried by this air stream, the ions contained in or generated from the spray flow can easily reach the vicinity of the ion-drawing port. As a result, the probability of the ions' entry into the ion-drawing port increases, which increases the amount of ions transported into the subsequent stages and consequently improves the detection sensitivity. Since the drying gas is not directly supplied into the region closer to the spray port of the spraying device as viewed from the ion-drawing port in the region surrounding the ion-drawing port, the situation in which ions moving toward the ion-drawing port are pushed back and kept away from the ion-drawing port does not occur. Thus, the decrease in the ion-drawing efficiency due to the operation for promoting the drying is avoided.

In the atmospheric pressure ionization mass spectrometer according to the second aspect of the present invention, a plurality of drying-gas supplying ports are provided around the ion-drawing port, and the flow rates of the drying gas supplied from the drying-gas supplying ports can be regulated with the flow rate regulator. Therefore, for example, it is possible to stop the supply of the drying gas from a drying-gas supplying port located closer to the spray port of the spraying device as viewed from the ion-drawing port in a region surrounding the ion-drawing port while allowing the drying gas to be supplied only from another drying-gas supplying port located farther from the spray port of the spraying device as viewed from the ion-drawing port, so as to produce the same effect as in the case of the atmospheric pressure ionization mass spectrometer according to the first aspect of the present invention and improve the ion-drawing efficiency.

Furthermore, in the atmospheric pressure ionization mass spectrometer according to the second aspect of the present invention, it is possible to incompletely stop the supply of the drying gas from the drying-gas supplying port located closer to the spray port of the spraying device as viewed from the ion-drawing port in a region surrounding the ion-drawing port, so as to allow a small amount of drying gas to flow out from this port (at a rate lower than the flow rate of the gas from the drying-gas supplying port located farther from the spray port of the spraying device as viewed from the ion-drawing port). By this operation, it is possible to improve the droplet-drying efficiency while barely affecting the ion-drawing efficiency, so as to achieve an overall improvement in the ion detection sensitivity.

Thus, in the atmospheric pressure ionization mass spectrometer according to the second aspect of the present invention, the flow rates of the drying gas to be supplied from the plurality of drying-gas supplying ports arranged around the ion-drawing port can arbitrarily be set. Therefore, for example, it is possible to regulate each of the flow rates of the drying gas so as to maximize the ion detection sensitivity according to various analysis conditions, such as the amount of liquid sample to be sprayed from the spraying device (i.e. the flow rate or the flow velocity of the liquid sample to be supplied to the spraying device), the viscosity of the liquid sample and the ambient temperature.

Accordingly, in one preferable mode of the second aspect of the present invention, the atmospheric pressure ionization mass spectrometer further includes a controller for monitoring an ion detection signal while regulating the flow rate of the drying gas supplied from each of the drying-gas supplying ports through the flow rate regulator and for setting each of the flow rates of the drying gas so as to maximize the ion detection sensitivity.

In the previously described system, for example, while a known sample (e.g. a standard sample) is preliminarily analyzed under the same analysis conditions as will be applied in an analysis of a target sample, the controller finds optimal flow rates of the drying gas and stores the values as part of the analysis parameters. Later on, in an analysis of the target sample, the highest possible ion detection sensitivity for the analysis conditions used at that time can be achieved by setting the flow rates of the drying gas by controlling the flow rate regulator according to the stored analysis parameters.

Advantageous Effects of the Invention

In the atmospheric pressure ionization mass spectrometer according to the present invention, the ions generated in an ionization chamber can be efficiently transported into subsequent stages and subjected to mass spectrometry, so that the ion detection sensitivity will be higher than the conventional levels. In particular, the atmospheric pressure ionization mass spectrometer according to the second aspect of the present invention can maximize the ion detection sensitivity according to various analysis conditions. Therefore, for example, an improvement in the ion detection sensitivity can be achieved in various kinds of ion sources ranging from a commonly used ESI ion source to a so-called "nano-ESI (or micro-ESI)" ion source in which a liquid sample is sprayed at an extremely low rate.

DESCRIPTION OF EMBODIMENTS

Figure 1:
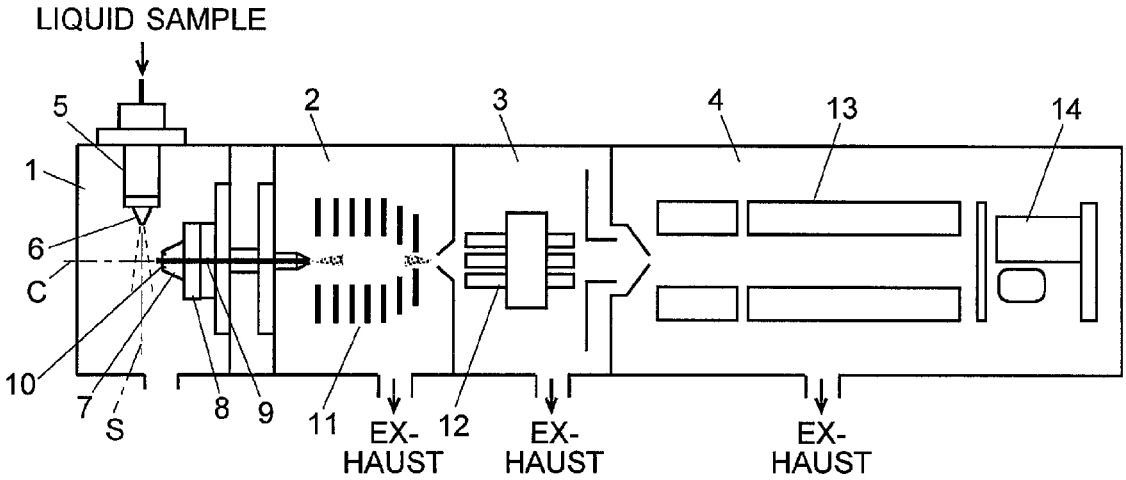
FIG. 1 is an overall configuration diagram of an atmospheric pressure ionization mass spectrometer as the first embodiment of the present invention.
Figure 2A:
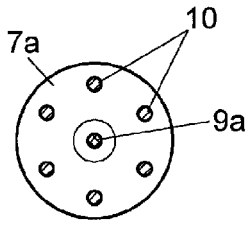
FIGS. 2A and 2B are respectively a plan view and a sectional view of an ion-drawing portion and its surrounding in the atmospheric pressure ionization mass spectrometer of the first embodiment.
Figure 2B:
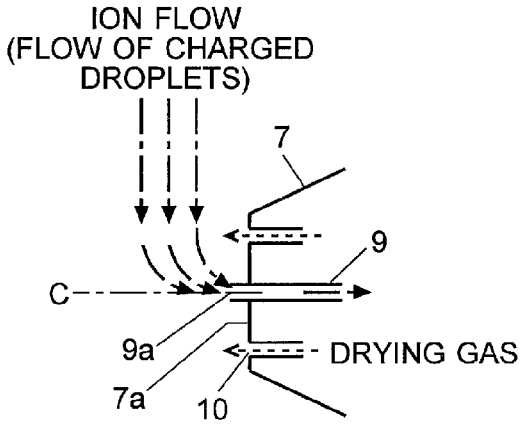
Figure 3:
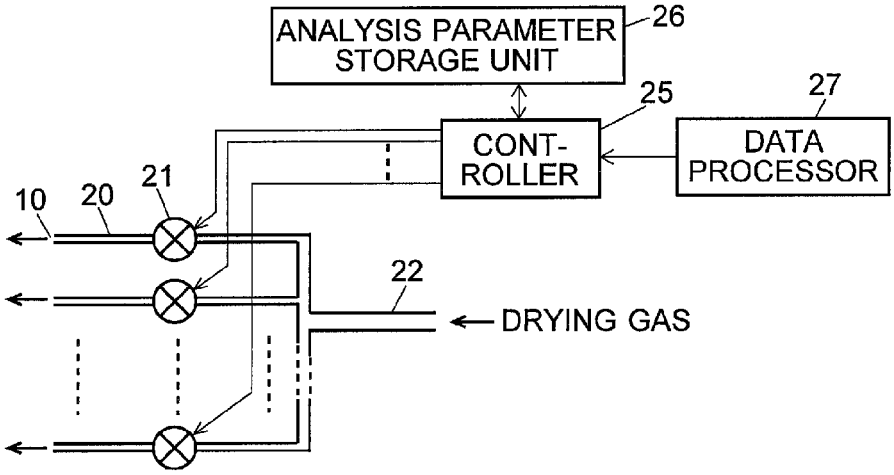
FIG. 3 is a configuration diagram of a control system for a drying-gas supply unit in the atmospheric pressure ionization mass spectrometer of the first embodiment.

The first embodiment of the atmospheric pressure ionization mass spectrometer according to the present invention is hereinafter described with reference to the attached drawings. FIG. 1 is an overall configuration diagram of an atmospheric pressure ionization mass spectrometer of the first embodiment. FIGS. 2A and 2B are respectively a plan view and a schematic sectional view of an ion-drawing portion and its surrounding in the atmospheric pressure ionization mass spectrometer of the first embodiment. FIG. 3 is a configuration diagram of a control system for a drying-gas supply unit in the atmospheric pressure ionization mass spectrometer of the first embodiment.

The atmospheric pressure ionization mass spectrometer of the present embodiment includes an ionization chamber 1 maintained at approximately atmospheric pressure, an analyzing chamber 4 maintained in a high vacuum state by evacuation using a turbo-molecular pump or similar vacuum pump (not shown), as well as the first and second intermediate vacuum chambers 2 and 3 each of which is maintained at an intermediate gas pressure between the gas pressure in the ionization chamber 1 and the gas pressure in the analyzing chamber 4 by evacuation using a vacuum pump. That is to say, the present atmospheric pressure ionization mass spectrometer has the configuration of a multi-stage differential pumping system in which the gas pressure decreases (or the degree of vacuum increases) at each chamber from the ionization chamber 1 toward the analyzing chamber 4.

The ionization chamber 1 contains an ionization probe 5 connected to the outlet of a column of a liquid chromatograph (not shown). The analyzing chamber 4 contains a quadrupole mass filter 13 and an ion detector 14. The first and second intermediate vacuum chambers 2 and 3 respectively contain a first ion guide 11 and a second ion guide 12 for transporting ions to the subsequent stages. The ionization chamber 1 and the first intermediate vacuum chamber 2 communicate with each other through a thin desolvation pipe 9. The first and second intermediate vacuum chambers 2 and 3 communicate with each other through a small passage hole. The second intermediate vacuum chamber 3 and the analyzing chamber 4 also communicate with each other through a small passage hole.

The desolvation pipe 9 has an end opening which is directed into the ionization chamber 1 and serves as an ion-drawing port 9*a*. The ion-drawing port 9*a* protrudes from the center of a head-cut circular face 7*a* of a sampling cone 7 which is a head-cut conical part attached to a block heater 8 that is almost uniformly heated by a heater (not shown). In the head-cut circular face 7*a*, a plurality of drying-gas supplying ports 10 (in the present embodiment, six ports) are provided at regular intervals of angle (in the present embodiment, 60 degrees) on a circle concentric with the ion-drawing port 9*a* in such a manner as to surround the ion-drawing port 9*a* (see FIG. 2A). In the first embodiment, the central axis of the nozzle 6 at the tip of the ionization probe 5 (and hence the central axis S of a spray flow ejected from the nozzle 6 as will be described later) is approximately orthogonal to the central axis C of the ion-drawing port 9*a*.

As shown in FIG. 3, the six drying-gas supplying ports 10 respectively consist of the end holes of six independent drying-gas supply branch pipes 20. Each drying-gas supply branch pipe 20 is provided with a flow valve 21 whose degree of opening can electrically be regulated. The degree of opening of each flow valve 21 is controlled by a controller 25. An analysis parameter storage unit 26 for storing the degree of opening or the flow rate of each flow valve 21 as one of the analysis parameters is connected to the controller 25. A data processor 27 processes detection signals from the ion detector 14 and sends processing results to the controller 25.

In this flow control system, the drying gas (which is typically an N2 gas but is not limited to this kind of gas) supplied through a main drying-gas-supply, pipe 22 is divided into branch flows which pass through the drying-gas supply branch pipes 20 and reach the drying-gas supplying ports 10, with their respective flow rates individually regulated with the flow valves 21. In a conventional system, it is impossible to individually regulate the flow rate of the drying gas to be supplied from each drying-gas supplying port 10 into the ionization chamber 1. By contrast, in the system according to the first embodiment, the flow rate of the drying gas to be supplied from each of drying-gas supplying ports 10 can arbitrarily be regulated. It is naturally possible to stop the supplying of the drying gas from a portion of the drying-gas supplying ports 10.

One example of the operation of the atmospheric pressure ionization mass spectrometer of the present embodiment is hereinafter described. The following descriptions deal with a system using an ionization probe 5 designed for ESI. However, the descriptions are also basically applicable to a system using an ionization probe designed for APCI or APPI, since their difference merely exists in the mechanism of ionization and does not affect the characteristic elements of the present invention.

When an analysis is performed, a high voltage of a few to several kV is applied to the tip of the nozzle 6 from a direct-current high voltage source (not shown). When a liquid sample introduced into the ionization probe 5 reaches the tip of the nozzle 6, the liquid sample is given biased electric charges and sprayed into the ionization chamber 1. The micro droplets in the spray flow contain a considerable amount of mobile phase and solvent. Inside the ionization chamber 1, atmospheric gas is present at high density (as compared to the gas in the intermediate vacuum chamber 2 or 3 in the subsequent stages), and the droplets come in contact with this gas, to be further divided. As the mobile phase and the solvent vaporize, the droplets become even smaller in size. During this process, the sample components (molecules or atoms) in the droplets are released from the droplets together with the electric charges and turn into gaseous ions. Accordingly, the spray flow ejected from the nozzle 6 is a mixture of ions and droplets, in which the proportion of ions increases as the flow travels.

If one or more flow valves 21 are open, the drying gas supplies from the corresponding drying-gas supplying port or ports 10, as shown in FIG. 2B. The drying gas has the effect of promoting the vaporization of the solvent or mobile phase from the charged droplets in the spray flow. Additionally, it also has the effect of preventing the solvent or mobile phase from adhering to the inlet end (around the ion-drawing port 9*a*) of the desolvation pipe 9 before vaporization and causing contaminations. However, since the supplying direction of the drying gas from the drying-gas supplying ports 10 is opposite to the direction in which the ions are drawn through the ion-drawing port 9*a*, the drying gas supplied from the drying-gas supplying port 10 located on the same side as the nozzle 6 as viewed from the ion-drawing port 9*a* (in the present embodiment, the drying-gas supplying port above the ion-drawing port 9*a*) has the effect of pushing back the ions heading for the ion-drawing port 9*a*. Thus, the drying gas supplied from the drying-gas supplying ports 10 is generally effective for improving the ion generation efficiency but may possibly be disadvantageous in terms of the efficiency of drawing the generated ions.

In contrast with the conventional atmospheric pressure ionization mass spectrometer in which only the total flow rate of drying gas can be regulated, the atmospheric pressure ionization mass spectrometer of the present embodiment allows the flow rates of the drying gas supplied from the drying-gas supplying ports 10 to be individually regulated. A typical mode of flow regulation is to reduce the flow rate of the gas supplied from the drying-gas supplying port 10 above the ion-drawing port 9*a* and to increase the flow rate of the gas supplied from the drying-gas supplying port 10 below the ion-drawing port 9*a*. In this case, due to Bernoulli's law, the gas pressure in the region below the ion-drawing port 9*a* becomes lower than the gas pressure in the region above the same port. This pressure difference produces a stream of air, which helps the ions in the spray flow to gather around the ion-drawing port 9*a*. The ions which have come close to the ion-drawing port 9*a* are carried into the ion-drawing port 9*a* by a stream of atmospheric gas flowing through the ion-drawing port 9*a* into the desolvation pipe 9, which generates due to the pressure difference between the ionization chamber 1 and the first intermediate vacuum chamber 2. Thus, by decreasing the flow rate of the gas supplied from the drying-gas supplying port 10 above the ion-drawing port 9*a*, or by setting this flow rate to zero, it is possible to prevent the approaching ions from being pushed back as well as to produce a flow of drying gas which induces a new flow of air having the effect of attracting ions into the vicinity of the ion-drawing port 9*a*, so that a greater amount of ions will be drawn into the ion-drawing port 9*a* and sent through the desolvation pipe 9 into the first intermediate vacuum chamber 2.

The ions introduced into the first intermediate chamber 2 are converged by the first ion guide 11 and sent into the second intermediate chamber 3, where the ions are further converged by the second ion guide 12 and sent into the analyzing chamber 4. Among the ions introduced into the quadrupole mass filter 13, only the ions having a specific mass-to-charge ratio m/z corresponding to the voltages applied to the electrodes of the filter 13 are allowed to pass through this filter 13, to eventually arrive at and be detected by the ion detector 14. Accordingly, sending a larger amount of ions into the first intermediate vacuum chamber 2 increases the amount of ions to be subjected to the analysis in the quadrupole mass filter 13 and consequently improves the ion detection sensitivity.

The velocity and the state of dispersion of the spray flow ejected from the nozzle 6 in the ionization chamber 1 as well as the degree of volatility of the solvent and mobile phase depend on the flow velocity and the viscosity of the liquid sample introduced into the ionization probe 5. In the case where a column of a liquid chromatograph (LC) is connected in the previous stage of the ionization probe 5, the flow velocity, viscosity and other properties of the liquid sample are included in the analyzing conditions for the LC. In the atmospheric pressure ionization mass spectrometer of the present embodiment, since the flow rates of the drying gas supplied from the drying-gas supplying ports 10 can individually be regulated, it is possible to appropriately regulate the flow rates of the drying gas so as to maximize the ion detection sensitivity even if the analyzing conditions for the LC are changed.

For example, if the flow rate of the liquid sample introduced into the ionization probe 5 is low, the solvent and the mobile phase almost completely vaporize when the liquid sample is sprayed from the nozzle 6, and the effect of the drying gas is less important for the drying process. Under such an analyzing condition, the supplying of the drying gas from the drying-gas supplying port 10 above the ion-drawing port 9*a* is completely stopped, and the drying-gas is supplied only from the drying-gas supplying port 10 below the ion-drawing port 9*a*. This setting improves the ion-drawing efficiency since it prevents the situation in which ions are pushed back by the drying gas supplied from the drying-gas supplying port 10 above the ion-drawing port 9*a*. On the other hand, if the analysis is performed under the condition that the liquid sample introduced into the ionization probe 5 at a high flow rate, the mobile phase and the solvent are less likely to vaporize from the droplets in the spray flow. In such a situation, emphasis should be put on the promotion of the drying process, and for this purpose, a small amount of drying gas is also allowed to flow out from the drying-gas supplying port 10 above the ion-drawing port 9*a*. Although the ions are thereby pushed back to some extent, the ion generation efficiency will relatively be improved due to the promoted drying of the droplets and the consequent improvement in the ion generation efficiency.

The controller 25 has the function of automatically conducting the previously described process of optimizing the flow rates of the drying gas according to analyzing conditions. Specifically, when a command for performing automatic regulation is entered by a user (or the like) before an analysis of a target component, the controller 25 conducts an analysis with a standard sample being introduced into the ionization probe 5. In this analysis, while the flow rate of the drying gas is varied by individually regulating the degree of opening of each of flow valves 21, the ion intensity for a known component is monitored to determine the degree of opening of each of flow valves 21 at which the ion intensity is maximized. The obtained results are stored as analysis parameters in the analysis parameter storage unit 26. Later on, in an analysis of the target sample, the controller 25 reads the analysis parameters from the analysis parameter storage unit 26 and sets the degree of opening of each of flow valves 21 according to those parameters. Such an optimization of the parameters can be performed simultaneously with the optimization (or "auto-tuning") of other parameters, such as the voltages applied to the system components. With this system, an analysis can be performed with the flow rates of the drying gas optimized for the analyzing conditions used at that time, without any special degree of user awareness. Thus, an analysis with high detection sensitivity can be performed regardless of the analyzing conditions.

An atmospheric pressure ionization mass spectrometer according to the second embodiment of the present invention is hereinafter described with reference to FIG. 4. The configuration of the atmospheric pressure ionization mass spectrometer according to the second embodiment only differs from the first embodiment in terms of the drying-gas supplying port 10 and other components specifically related to the supplying of the drying gas. Accordingly, only those components will be described.

Figure 4A:
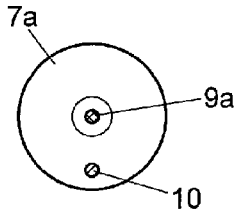
FIGS. 4A and 4B are respectively a plan view and a sectional view of an ion-drawing portion and its surrounding in an atmospheric pressure ionization mass spectrometer as the second embodiment of the present invention.
Figure 4B:
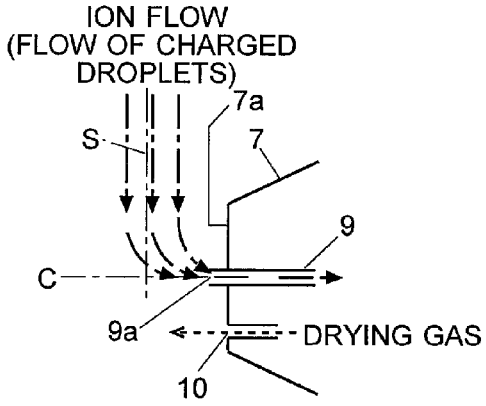

FIGS. 4A and 4B are respectively a plan view and a sectional view of an ion-drawing portion and its surrounding in the atmospheric pressure ionization mass spectrometer as the second embodiment of the present invention. Unlike the first embodiment in which a plurality of drying-gas supplying ports 10 are arranged in such a manner as to surround the ion-drawing port 9*a*, the system of the second embodiment has a single drying-gas supplying port 10 located at a position below the ion-drawing port 9*a*. The position below the ion-drawing port 9*a* is a position located on the side opposite to the nozzle 6 producing the spray flow as viewed from the ion-drawing port 9*a*. The aim of this design is as follows: As described earlier, in the first embodiment, the amounts of the drying gas supplied from the plurality of drying-gas supplying ports 10 can be individually regulated, and therefore, it is possible to let the drying gas be supplied only from the drying-gas supplying port 10 below the ion-drawing port 9*a*. In the second example, this situation is permanently created by providing the single drying-gas supplying port 10 below the ion-drawing port 9*a*. It should be noted that, though not shown, a flow valve is provided in the drying-gas pipeline for supplying the drying gas to the drying-gas supplying port 10 below the ion-drawing port 9*a*, and the flow rate of the drying gas can thereby be regulated.

In the second embodiment, the drying gas is supplied in the direction opposite to the ion-drawing direction, only from the drying-gas supplying port 10 below the ion-drawing port 9*a*. Therefore, as explained earlier, the gas pressure in the region below the ion-drawing port 9*a* becomes lower than the gas pressure in the region above the same port, whereby a stream of air is produced. A flow of drying gas which pushes back the approaching ions will barely occur since there is no drying-gas supplying port above the ion-drawing port 9*a*. Therefore, the ion-drawing efficiency will be higher than in the conventional system, and consequently, the ion detection sensitivity will be improved.

The present system may also be configured so as to perform automatic regulation under the command of the controller 25 in the previously described manner in order to optimize the flow rate of the drying gas supplied from the single drying-gas supplying port 10 according to the analyzing conditions.

In the configuration shown in FIGS. 4A and 4B, the central axis S of the spray flow from the nozzle 6 is approximately orthogonal to the central axis C of the ion-drawing port 9*a*. However, the positional relationship between the nozzle 6 and the ion-drawing port 9*a* is not limited to this form.

Figure 5A:
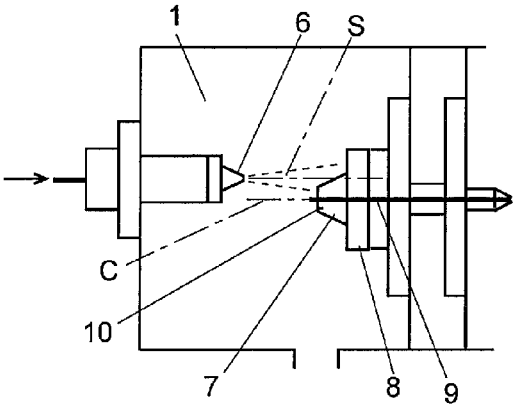
FIG. 5A is a configuration diagram of an ion source in an atmospheric pressure ionization mass spectrometer as the third embodiment of the present invention.
Figure 5B:
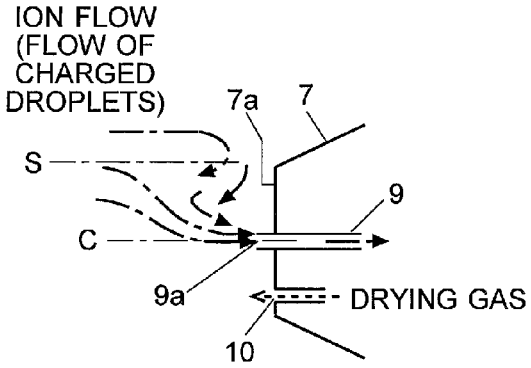
FIG. 5B is a sectional view of the ion-drawing portion and its surrounding in the mass spectrometer.

FIGS. 5A and 5B shows another example, in which the central axis S of the spray flow from the nozzle 6 and the central axis C of the ion-drawing port 9*a* are approximately parallel to each other and not on the same straight line. Once again, the drying-gas supplying port 10 is provided below the ion-drawing port 9*a* and hence at a position on the side opposite to the nozzle 6 producing the spray flow as viewed from the ion-drawing port 9*a*. Therefore, the ions contained in the spray flow from the nozzle 6 are attracted into the vicinity of the ion-drawing port 9*a*, to be eventually drawn into the ion-drawing port 9*a*.

Figure 6A:
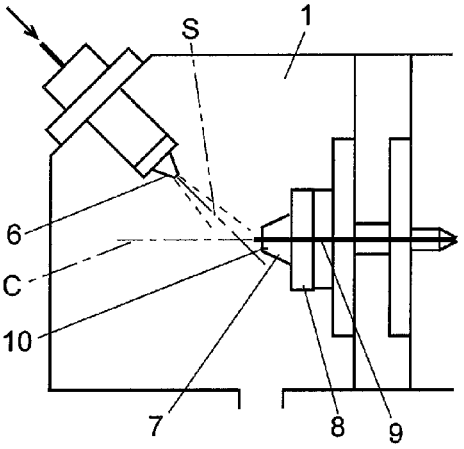
FIG. 6A is a configuration diagram of an ion source in an atmospheric pressure ionization mass spectrometer as the fourth embodiment of the present invention.
Figure 6B:
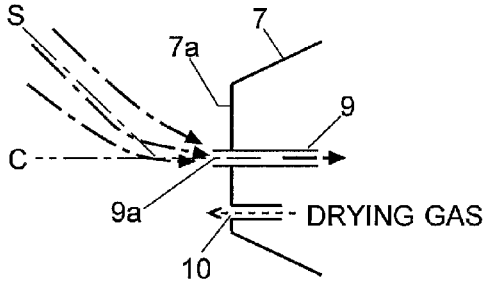
FIG. 6B is a sectional view of an ion-drawing portion and its surrounding in the mass spectrometer.

FIGS. 6A and 6B shows still another example, in which the central axis S of the spray flow from the nozzle 6 obliquely intersects with the central axis C of the ion-drawing port 9*a*. Once again, the drying-gas supplying port 10 is provided below the ion-drawing port 9*a* and hence at a position on the side opposite to the nozzle 6 producing the spray flow as viewed from the ion-drawing port 9*a*. Therefore, the ions contained in the spray flow from the nozzle 6 are attracted into the vicinity of the ion-drawing port 9*a*, to be eventually drawn into the ion-drawing port 9*a*.

Even if the central axis S of the spray flow from the nozzle 6 and the central axis C of the ion-drawing port 9*a* do not intersect with each other (i.e. they are not on the same plane) and are not parallel to each other, it is still preferable to similarly provide the drying-gas supplying port 10 at a position on the side opposite to the nozzle 6 producing the spray flow as viewed from the ion-drawing port 9*a*, whereby the ions contained in the spray flow from the nozzle 6 can be attracted into the vicinity of the ion-drawing port 9*a*, to be eventually drawn into the ion-drawing port 9*a*.

Naturally, in the case where the positional relationship between the nozzle 6 and the ion-drawing port 9*a* is set as shown in FIGS. 5A and 5B or FIGS. 6A and 6B, it is possible to provide a plurality of drying-gas supplying ports 10 as described in the first embodiment.

In the previously described embodiments, it was assumed that the ionization probe 5 was designed for ESI. However, the present invention can naturally be applied in the case where an ionization probe designed for APCI or APPI is used, i.e. in the case where the ionization is achieved by an atmospheric pressure ionization method other than ESI. It should also be noted that the previous embodiments are mere examples of the present invention and will evidently be included the scope of claims of the present patent application even if a change, modification or addition within the spirit of the present invention is appropriately made in some aspects other than the already mentioned ones.

REFERENCE SIGNS LIST

1 . . . Ionization Chamber
2 . . . First Intermediate Vacuum Chamber
3 . . . Second Intermediate Vacuum Chamber
4 . . . Analyzing Chamber
5 . . . Ionization Probe
6 . . . Nozzle

7 . . . Sampling Cone
8 . . . Block Heater
9 . . . Desolvation Pipe
9*a* . . . Ion-Drawing Port
10 . . . Drying-Gas Supplying Port
11 . . . First Ion Guide
12 . . . Second Ion Guide
13 . . . Quadrupole Mass Filter
14 . . . Ion Detector
20 . . . Drying-Gas Supply Branch Pipe
21 . . . Flow Valve
22 . . . Main Drying Supply Drying-Gas-Supply Pipe
25 . . . Controller
26 . . . Analysis Parameter Storage Unit
27 . . . Data Processor
C . . . Central Axis of Ion-Drawing Port
S . . . Central Axis of Spray Flow

The invention claimed is:

1. An atmospheric pressure ionization mass spectrometer having: a spray device for spraying a liquid into an ionization chamber whose inner space is maintained at atmospheric pressure; and an ion-drawing port for drawing ions generated from micro droplets sprayed from the spray device so as to transport the ions to a subsequent stage maintained at a low gas pressure, the central axis of the ion-drawing port being unidentical with the central axis of a spray flow from the spraying device, wherein:

the mass spectrometer includes a drying-gas supplying port located in a region surrounding the ion-drawing port and at least on a side of the central axis of the ion-drawing port opposite to a side where the spray port of the spraying device is located, the drying-gas supplying port being arranged so as to supply a drying gas in a direction opposite to a direction in which ions are drawn through the ion-drawing port; and the drying gas is supplied only from the aforementioned drying-gas supplying port.

2. An atmospheric pressure ionization mass spectrometer having: a spray device for spraying a liquid into an ionization chamber whose inner space is maintained at atmospheric pressure; and an ion-drawing port for drawing ions generated from micro droplets sprayed from the spray device so as to transport the ions to a subsequent stage maintained at a low gas pressure, the central axis of the ion-drawing port being unidentical with the central axis of a spray flow from the spraying device, the mass spectrometer including:

a) a plurality of drying-gas supplying ports provided around the ion-drawing port in such a manner as to surround the ion-drawing port; and b) a flow rate regulator for independently regulating a flow rate of the drying gas supplied from each of the drying-gas supplying ports.

3. The mass spectrometer according to claim 2, wherein:

the plurality of drying-gas supplying ports are arranged at regular intervals of angle on a circle concentric with the ion-drawing port.

4. The atmospheric pressure ionization mass spectrometer according to claim 2, further comprising:

a controller for monitoring an ion detection signal while regulating each of the flow rates of the drying gas supplying from the drying-gas supplying ports through the flow rate regulator and for setting each of the flow rates of the drying gas so as to maximize an ion detection sensitivity.

5. The atmospheric pressure ionization mass spectrometer according to claim 3, further comprising:

a controller for monitoring an ion detection signal while regulating each of the flow rates of the drying gas supplying from the drying-gas supplying ports through the flow rate regulator and for setting each of the flow rates of the drying gas so as to maximize an ion detection sensitivity.

* * * * *